US006422143B1

(12) United States Patent
Lawrence et al.

(10) Patent No.: US 6,422,143 B1
(45) Date of Patent: Jul. 23, 2002

(54) FLEXOGRAPHIC PREVIEW PRINTER

(75) Inventors: Scott D. Lawrence, 2905 N. Lindbergh, St. Ann, MO (US) 63074; Shawn W. Davis, St. Peters; David R. Henke, Moscow Mills, both of MO (US)

(73) Assignee: Scott D. Lawrence, St. Ann, MO (US)

( * ) Notice: Subject to any disclaimer, the term of this patent is extended or adjusted under 35 U.S.C. 154(b) by 0 days.

(21) Appl. No.: 09/748,575

(22) Filed: Dec. 26, 2000

(51) Int. Cl.[7] ..... B41F 31/06; B41F 31/00

(52) U.S. Cl. ..... 101/216; 101/349.1; 101/350.1; 101/352.01

(58) Field of Search ..... 101/216, 349.1, 101/350.1, 351.6, 352.01

(56) References Cited

U.S. PATENT DOCUMENTS

| | | | | |
|---|---|---|---|---|
| 2,190,740 | A | 2/1940 | Swift et al. | 101/216 |
| 2,245,618 | A | 6/1941 | Stafford et al. | 101/216 |
| 2,988,989 | A | 6/1961 | Crawford | 101/152 |
| 3,268,982 | A | 8/1966 | Schutze | 29/895.3 |
| 4,004,509 | A | 1/1977 | Moss | 101/216 |
| 4,015,524 | A | 4/1977 | Herbert | 101/247 |
| 4,019,434 | A | 4/1977 | Hoexter | 101/216 |
| 4,522,057 | A | 6/1985 | Kerchiss | 73/150 R |
| 4,558,643 | A | 12/1985 | Arima et al. | 101/158 |
| 4,852,486 | A | 8/1989 | Ely et al. | 101/218 |
| 4,936,212 | A | 6/1990 | Moss | 101/216 |
| 4,989,037 | A | 1/1991 | Nagatsuna | 355/200 |
| 5,485,782 | A | 1/1996 | Van Der Horst | 101/216 |
| 5,495,800 | A | 3/1996 | Weissbein et al. | 101/329 |

*Primary Examiner*—Daniel J. Colilla
(74) *Attorney, Agent, or Firm*—Grace J. Fishel

(57) ABSTRACT

A flexographic preview printer for duplicating conditions of a contemplated press run. The preview printer includes an inking unit and a printing unit. The inking unit has an ink roller and an anilox roller with a doctor blade for precision metering of the ink on the anilox roller. The printing unit includes a plate roller and a drive roller. The nip between the plate roller and the drive roller is adjustable. There are first and second motors and first and second gear trains. The first motor and gear train drives the inking unit at a set slow speed through a throw-out clutch. The second motor and gear train drives the printing unit at a speed that is higher than the speed at which the first motor rotates the inking unit. The second gear train is meshed with the first gear train through a throw-in clutch. The second gear train drives the first gear train through the throw-in clutch when the second motor is activated while the first gear train is disengaged from the first motor by the throw-out clutch.

14 Claims, 6 Drawing Sheets

FLEXOGRAPHIC PREVIEW PRINTER

BACKGROUND OF THE INVENTION

1. Field of the Invention

The present invention relates to a flexographic preview printer which duplicates conditions of a contemplated printing run on a commercial printing machine. It allows an ink supplier to test its ink under the customer's printing conditions thereby improving quality control.

2. Brief Description of the Prior Art

In a flexographic printing machine, a plate roller with a raised image is inked with an anilox roller. A substrate is then passed through the nip between a drive roller and the plate roller picking up the reverse of the raised image on the plate roller. Modern flexographic machinery is capable of producing color exacting copies at high speed.

It is well known that the substrate, printing speed and printing pressure and ink metering has an affect on the thickness of the ink film which determines the color achieved on the printed article. Flexographic printing inks must be formulated to provide the desired color under the contemplated printing conditions.

There are hand proofers which apply the ink being tested to the substrate by manually rolling the hand proofers across the substrate. Hand proofers are not capable of providing consistent results because of three major variables. First, the speed with which the operator rolls the hand proofer varies from operator to operator and even with the same operator. Second, the pressure with which the operator presses the hand proofer onto the substrate varies in the same way. Third, there is no mechanism for consistent metering of the ink on the anilox roller. Because of these variables, it is virtually impossible to obtain repeatable proofs, i.e. proofs which are substantial duplicates of each other, even when the same operator uses the same hand proofer and the same ink.

There are manual and automated proofers but none of them effectively simulate the exact press speed and pressure of a flexographic printer (i.e., they do not duplicate the same conditions encountered in a press run).

BRIEF SUMMARY OF THE INVENTION

In view of the above, it is an object of the present invention to provide a preview printer that duplicates conditions of a contemplated press run. It is another object to provide a preview printer for testing a printing ink under the customer's printing conditions thereby improving quality control. It is also an object to provide a preview printer that is easy to clean between tests. Other objects and features of the invention will be in part apparent and in part pointed out hereinafter.

In accordance with the invention, a flexographic preview printer has an inking unit and a printing unit. The inking unit has an inking roller in contact with an anilox roller for transferring ink from the inking roller to the anilox roller and a doctor blade for precision metering of the ink on the surface of the anilox roller. The printing unit has a plate roller with an image to be printed and a drive roller for moving a substrate through a nip between the drive roller and the plate roller with the nip adjustable to the thickness of the substrate.

The inking unit is powered by a first gear train connected to a first motor through a throw-out clutch. The first motor is initially activated and adapted to rotate the inking roller and the anilox roller at a set slow speed.

The printing unit is powered by a second gear train meshed with the first gear train through a throw-in clutch and driven by a second motor. The second motor is initially inactivated and adapted to rotate the plate roller and the drive roller at an adjustable speed that is higher than the speed at which the first motor rotates the inking roller and the anilox roller. The second motor is activated when said anilox roller is selectively brought into contact with the plate roller. The anilox roller being in a rotational ratio of one to one with the plate roller.

The second motor drives the second gear train and the second gear train drives the first gear train through the throw-in clutch when the second motor is activated. The first gear train is disengaged from the first motor through the throw-out clutch when the first gear train is driven by the second gear train. In operation, the inking unit is rotated at a set slow speed by the first motor and then disengaged from the first motor when the second motor is activated rotating the printing and inking units at an adjustable faster speed.

The invention summarized above comprises the constructions hereinafter described, the scope of the invention being indicated by the subjoined claims.

BRIEF DESCRIPTION OF THE SEVERAL VIEWS OF THE DRAWING

In the accompanying drawings, in which several of various possible embodiments of the invention are illustrated, corresponding reference characters refer to corresponding parts throughout the several views of the drawings in which.

DETAILED DESCRIPTION OF THE INVENTION

Figure 1:
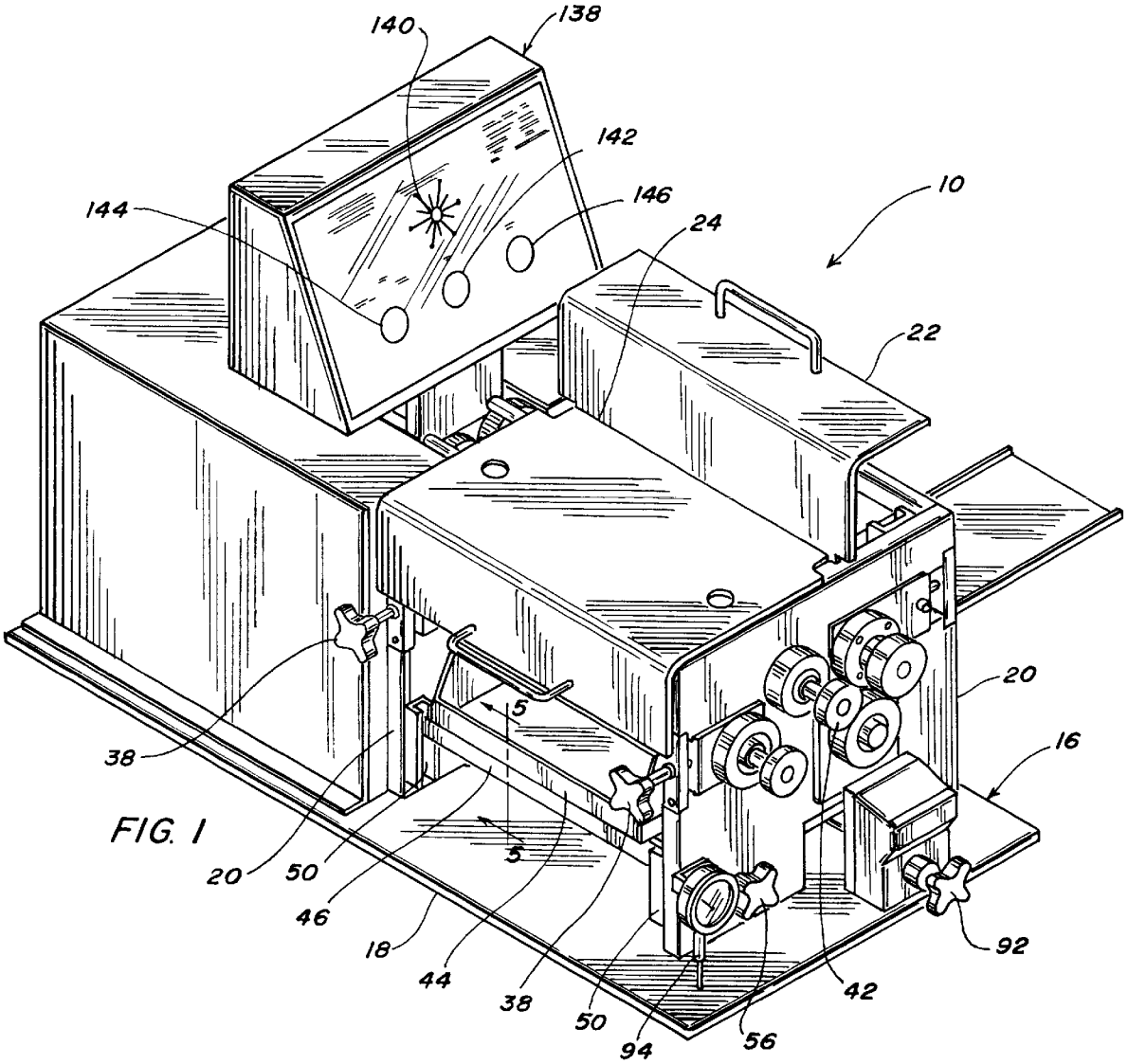
FIG. 1 is a perspective view of a preview printer in accordance with the present invention.

Referring to the drawings more particularly by reference number, reference numeral 10 refers to a preview printer in accordance with the present invention. The purpose of preview printer 10 is to duplicate the conditions encountered in a press run of a full-size flexographic printer at a given press speed, pressures and ink metering with a particular ink and substrate.

In major part, preview printer 10 has an inking unit 12 and a printing unit 14. Inking unit 12 and printing unit 14 are supported by a frame 16 including a base 18 upon which is mounted a pair of spaced apart parallel sidewalls 20. A safety cover 22 may be provided. Cover 22 is hinged 24 such that inking unit 12 and printing unit 14 may be accessed without removing the cover.

Inking unit 12 includes a inking roller 26 in contact with an anilox roller 28 for transferring ink from the inking roller to the anilox roller. A doctor blade 30 is provided for precision metering of the ink on the anilox roller 28. Doctor blade 30 is movable relative to sidewalls 20 by screw adjusters 32 such that the angle of attack and pressure applied to anilox roller 28 is adjustable for metering purposes. For use in making proofs, anilox roller 28 is preferably banded. A banded anilox roller is engraved in sections or bands 34 with different line screens and volumes which allows an economical running of trials for testing ink, substrates, etc. Each band 34 simulates an individual anilox roll, which reduces testing time and materials needed to identify the right anilox roller, ink, etc. For example, anilox roller 28 may have three bands 34: Band one, 440 line screen at 3.4 BCM volume; Band two, 600 line screen at 2.6 BCM and Band three, 700 line screen at 2.2 BCM. It will be understood that these details are merely illustrative and other anilox rollers, banded or not, may be used instead.

Figure 2:
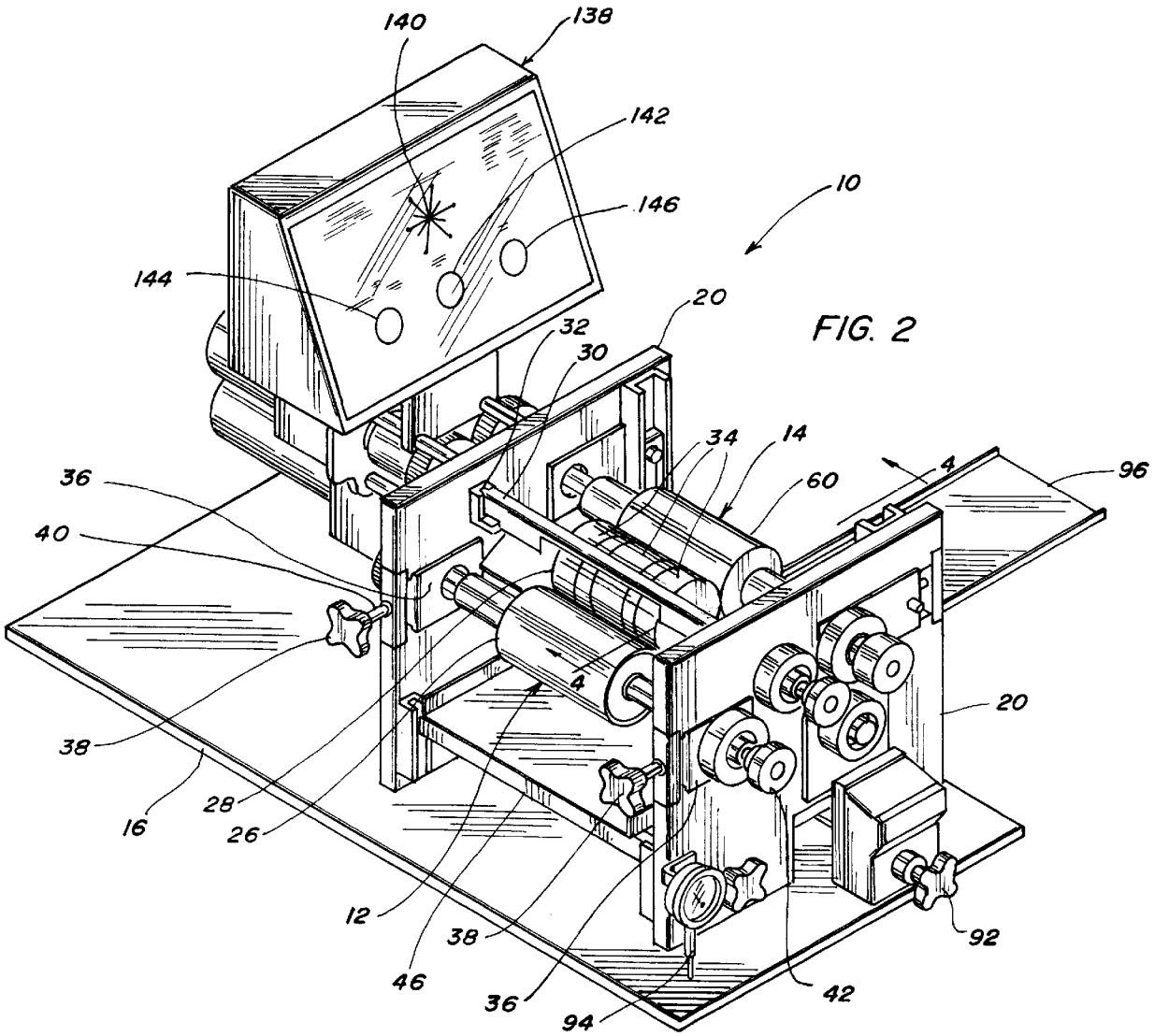
FIG. 2 is a perspective view like FIG. 1 but with a cover over the gear trains removed and with a safety cover over the inking unit and printing unit removed, as viewed from the inking unit side.

As shown in FIG. 2, inking roller 26 and anilox roller 28 are journaled in sidewalls 20. Inking roller 26 may be mounted on a pair of horizontal slides 36 received in slideways provided in sidewalls 20. Slides 36 may be reciprocated in slideways by rotating handles 38 connected to threaded members 40 fixed in an edge of sidewalls 20. As handles 38 are rotated, threaded members 40 are threaded in and out of slides 36, causing inking roller 26 to be brought in and out of contact with anilox roller 28. A spring loaded quick release 42 may be provided on inking roller 26 and anilox roller 28 such that they may be easily removed from preview printer 10 for cleaning.

Figure 5A:
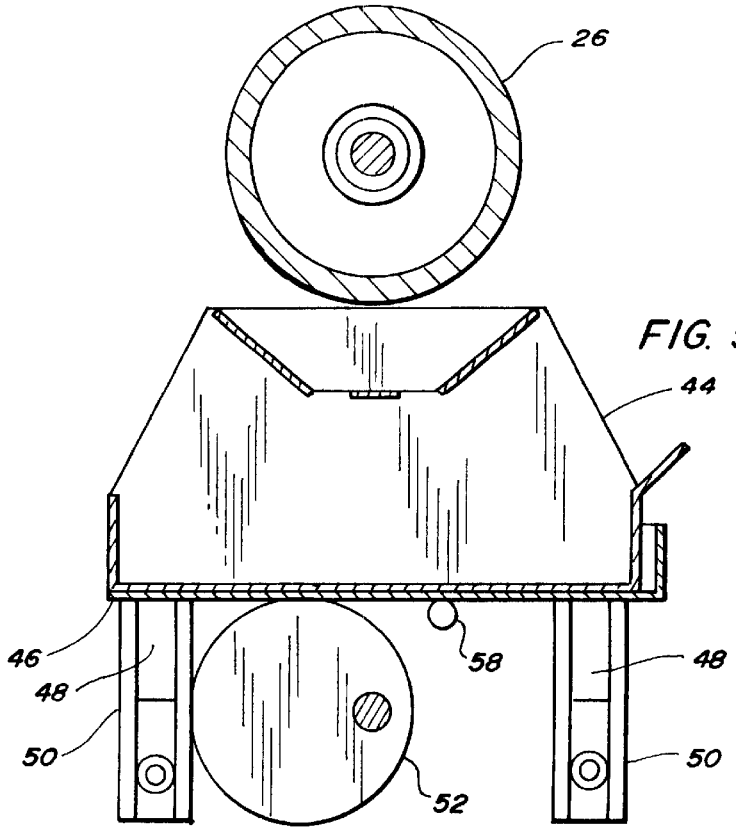
FIG. 5A is a detail taken along line 5—5 in FIG. 1 showing the ink tray below the inking roller.
Figure 5B:
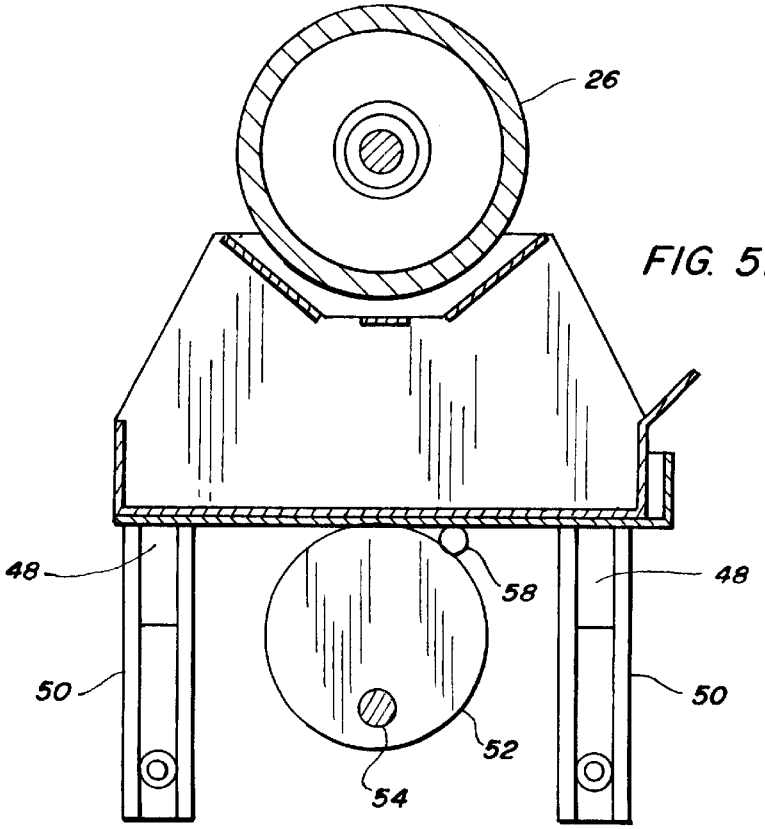
FIG. 5B is a view like FIG. 5A but showing the inking tray raised into contact with the inking roller; and, FIG. 6 is a detail showing a mechanism for raising and lowering the drive roller to establish a nip between the plate roller and drive roller between which a substrate is driven.

Inking roller 26 is mounted below anilox roller 28 with a lower portion of inking roller dipped into an ink tray 44 containing a sample of an ink to be tested. Ink tray 44 may be mounted on a horizontal platform 46 which can be raised and lowered, thereby moving ink tray 44 in and out of contact with inking roller 26. As shown in FIGS. 5A and 5B, platform 46 is rectangular with a vertical slide 48 provided at each corner. Slides 48 are received in vertical guideways 50 provided on the inside of sidewalls 20. A pair of cams 52 are mounted on a rod 54 journaled in sidewalls 20 under platform 46. A handle 56 is provided on the outside of one of sidewalls 20 for rotating rod 54. With continuing references to FIGS. 5A and 5B, ink tray 44 on platform 46 can be moved up and down by rotating cams 52 on rod 54. A stop 58 is provided on the inside of one or both of sidewalls 20 to prevent cams 52 from rotating over center.

Figure 3:
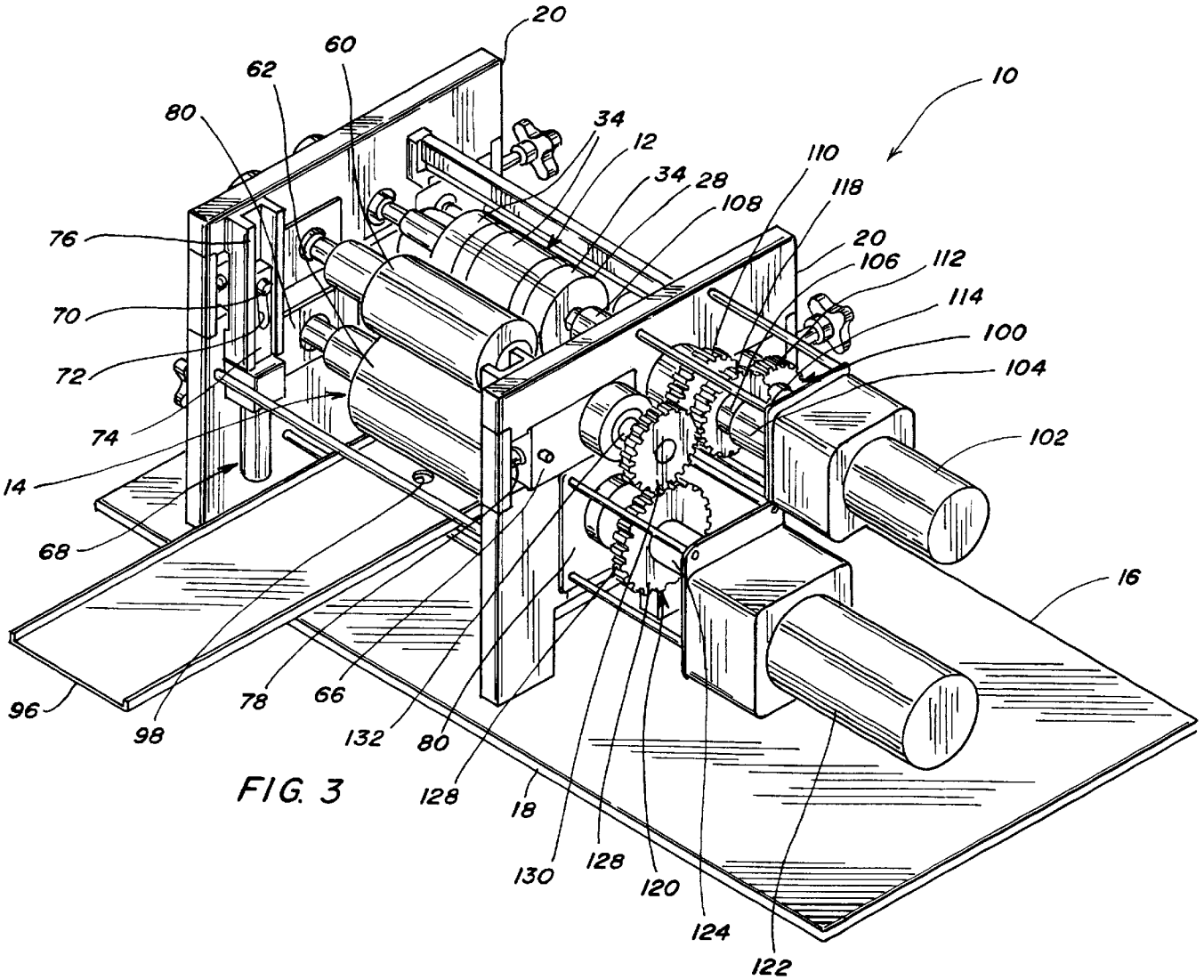
FIG. 3 is a perspective view like FIG. 2 but viewed from the printing unit side.
Figure 4A:
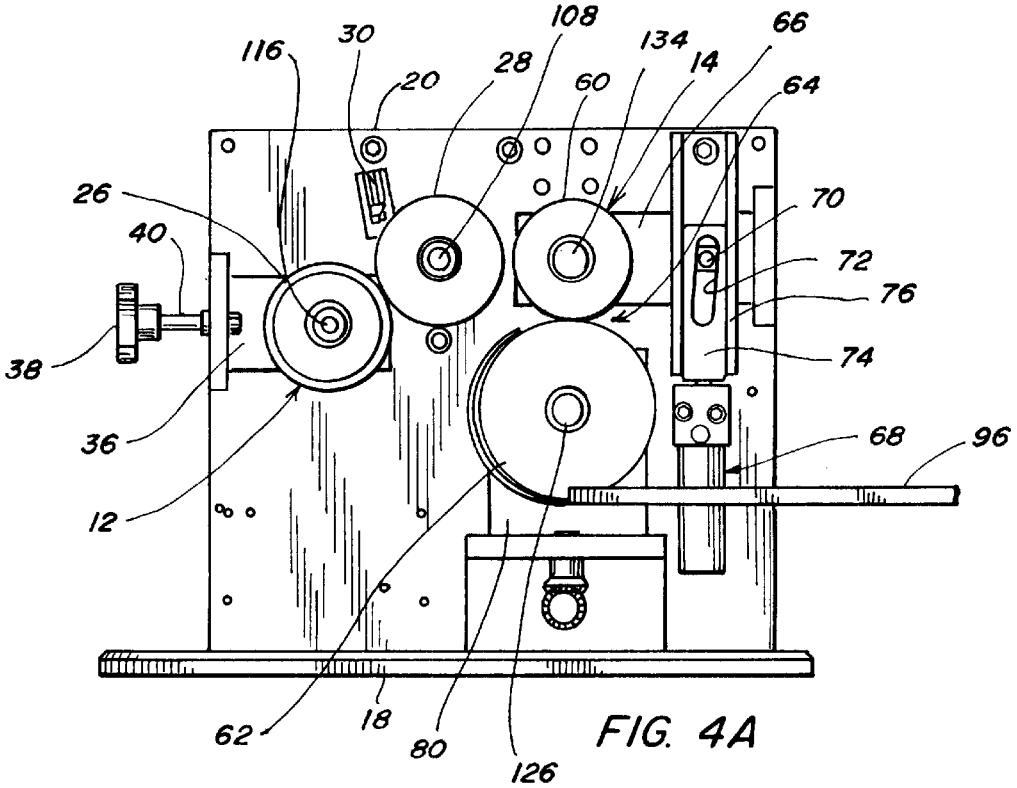
FIG. 4A is a view taken along line 4—4 in FIG. 2 showing the pneumatic ram in initial position.
Figure 4B:
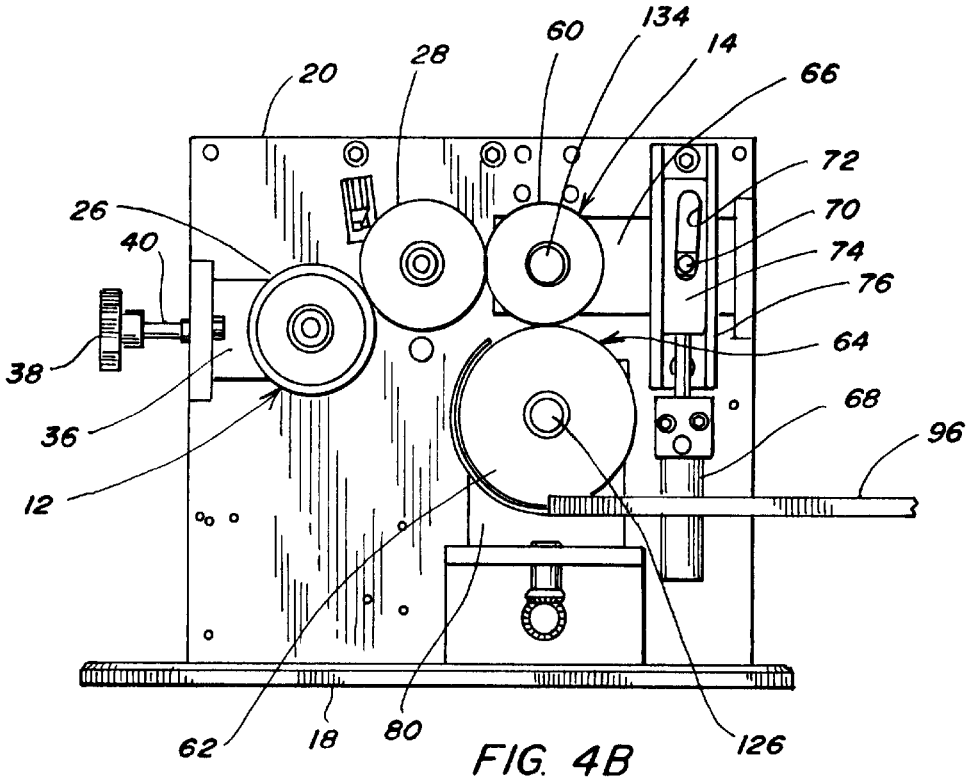
FIG. 4B is a view like FIG. 4A but with the pneumatic ram in extended position.

As shown in FIG. 3, printing unit 14 includes a plate roller 60 with a changeable plate material on which is formed an image to be printed and a drive roller 62 for moving a substrate (not shown) through a nip 64 between the drive roller and the plate roller. When anilox roller 28 has bands 34, images printed from the bands enable comparison among the prints produced under the same conditions of substrate, plate speed, pressures, etc. Plate roller 60 and drive roller 62 are journaled in sidewalls 20. Plate roller 60 is mounted on a pair of horizontal slides 66 received in slideways provided in sidewalls 20. Slides 66 may be reciprocated in slideways by action of a pair of pneumatic rams 68. As best seen in FIGS. 4A and 4B, a pin 70 on each of slides 66 is received in an angled slot 72 in an elongated vertical plate 74. Plate 74 is contained in a slideway 76 attached to the inside of one of sidewalls 20. Plate 74 is attached to a piston rod of pneumatic ram 68. With continuing reference to FIGS. 4A and 4B, it will be seen that as plate 74 is reciprocated in slideway 76 by pneumatic ram 68, pin 70 is moved along angled slot 72 such that plate roller 60, mounted on slide 66, is brought into and out of contact with anilox roller 28. A coil spring 78 may be provided on each of slides 66 for biasing plate roller 60 towards anilox roller 28.

Figure 6:
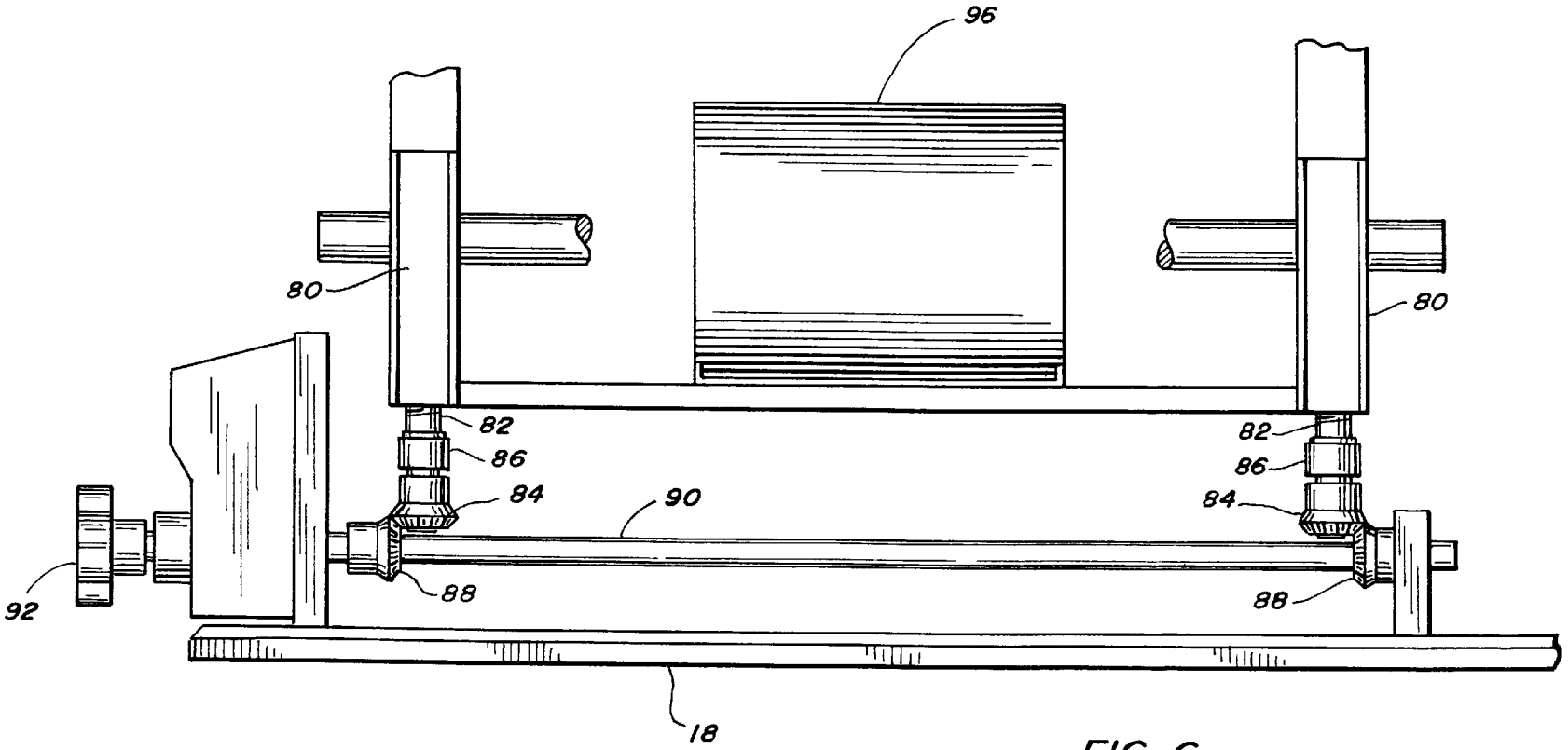

Drive roller 62 is mounted on a pair of vertical slides 80 received in slideways provided in sidewalls 20, best seen in FIG. 6. Each of slides 80 is mounted on a threaded member 82 which terminates in a bevel gear 84. A brace 86 attached to sidewalls 30 abuts bevel gear 84 prevents threaded member 82 from traveling. Bevel gear 84 is meshed with another bevel gear 88 mounted on a rod 90 journaled in the sidewalls 20. A handle 92 is provided on the outside of sidewalls 20 for setting nip 64 between drive roller 62 and plate roller 60 to the thickness of the substrate to be printed by threading members 82 in and out of slides 80. A dial caliper 94 may be provided on sidewall 20 for measuring the thickness of the substrate, which finding is then used to set nip 64 such that a constant drive pressure is applied to the substrate as it is printed. A chute 96 is provided for directing a substrate around drive roller 62 and into nip 64. Chute 96 may include an aperture 98 for use with an electric eye (not shown) for sensing the presence of a substrate.

Inking unit 12 is powered by a first gear train 100 connected to a first motor 102 through a coupling 104 which is a throw-out clutch. First gear train 100 includes a shaft 106 attached to coupling 104 and to an axle 108 of anilox roller 28 which is journaled in sidewalls 20. Mounted on shaft 106 is a gear 110 in mesh with a second gear 112 on a second shaft 114. Second shaft 114 is attached to an axle 116 of inking roller 36 which is also journaled in sidewalls 20. A third gear 118 with a throw-in clutch, whose use is described hereinafter is mounted on shaft 106. When first motor 102 is activated, anilox roller 28 and inking roller 26 are rotated in a one to one rotational ratio at a set slow speed that is not so fast that the ink slings off inking roller 26 or dries on anilox roller 28. Coupling 104 and third gear 118 are preferably sprag gears.

Printing unit 14 is powered by a second gear train 120 connected to a second motor 122. Second gear train 120 includes a shaft 124 connected to second motor 122 and to an axle 126 of drive roller 62 which is journaled in sidewalls 20. Mounted on shaft 124 is a gear 128 in mesh with a second gear 130 on a second shaft 132. Second shaft 132 is attached to an axle 134 of plate roller 60 which is also journaled in sidewalls 20. Second gear 130 is also in mesh with third gear 118 in the first gear train 100. When second motor 122 is activated, plate roller 60 and drive roller 62 are rotated in a one to one rotational ratio at a speed, duplicating the speed at which the substrate will be moved through the flexographic printer which is being simulated. This speed is controlled by controlling the speed of second motor 122.

As second gear 130 on shaft 124 rotates third gear 118 in the first gear train, throw-in clutch engages shaft 106, while throw-out clutch in coupling 104 disengages first gear train 100 from first motor 102 which continues to rotate as its set slow speed. Third gear 118 in first power train 100 and second gear 130 in second power train 120 are in a one to one rotational ratio such that all of the rollers are rotated in a one to one rotational ratio.

Shown in FIG. 1 and 2, a programmable logic controller 138 is provided with a panel having a plate roller speed indicator 140, an emergency stop switch 142, a mode selector control 144 and a jog switch 146. Mode selector control 144 allows an operator to select between a manual and an automatic mode. When the manual mode is selected, jog switch 146 starts second motor 122 and fires pneumatic rams 68 bringing plate roller 60 into contact with anilox roller 28. When jog switch 146 is deactivated, second motor 122 stops and pneumatic rams 68 retract plate roller 60. If the automatic mode is selected, when aperture 98 in chute 96 is blocked by a substrate, a timing function in controller may provide a time delay sufficient for an operator to push the substrate through chute 96 until it reaches nip 64. At which time, controller 138 starts second motor 122 and fires pneumatic rams 68. When the aperture is no longer blocked, controller 138 continues to operate second motor 122 for a time sufficient to discharge the substrate from the preview printer, whereafter controller stops second motor 122 and causes pneumatic rams 68 to retract. Controller 122 may also include an automatic shut off, if the preview printer 10 continues to operate for a longer than expected period of time, such as would happen if the aperture were accidentally blocked. Proximity switches may be provided on cover 22 and controller 138 programmed such that preview printer 10 cannot be started until the cover is closed.

In use, the thickness of the substrate to be printed in preview printer 10 is measured with dial caliper 94 or some other device. The spacing (nip 64) between drive roller 62 and plate roller 60 is set by rotating handle 92 to the thickness of the substrate. An anilox roller 28, or banded anilox roller, identical to the anilox roller to be used in the flexographic printer being simulated is installed in preview printer 10. An ink which is to be tested with anilox roller 28 is placed in ink tray 44. Platform 46 is then raised bringing the ink tray 44 into contact with the bottom of inking roller 26.

To start preview printer 10, emergency switch 142 is pulled out. When preview printer 10 is operated in the manual mode, mode selector control 144 is set to manual causing first motor 102 to start and inking unit 12 to operate. A substrate is then guided through chute 96 until it reaches nip 64 whereupon the operator presses jog switch 146. As long as jog switch 146 is pressed, second motor 122 operates, second gear train 120 taking over first gear train 100 by means of the throw-in clutch in third gear 118 and throw-out clutch in coupling 104. When jog switch 146 is deactivated, second motor 122 stops and pneumatic rams 68 return to starting position, retracting plate roller 60 from anilox roller 28. Until emergency switch 142 is depressed, inking unit 12 will continue to operate.

When preview printer 10 is operated in the automatic mode, mode selector control 144 is set to automatic, starting first motor 102 and causing inking unit 12 to operate. When a substrate is slid into chute 96, blocking aperture 98, an electric eye signals controller 138, a time delay is started sufficient for the operator to feed the substrate around drive roller 62 into nip 64. At which time controller 138 starts second motor 122 and fires pneumatic rams 68 bringing plate roller 60 into contact with anilox roller 28. After substrate has passed over aperture 98, a timing function in controller 138 causes preview printer 10 to continue to operate for a time sufficient that the substrate is cleared through the printer. At which time, controller 138 stops motor 122 and pneumatic rams 68 return to starting position, retracting plate roller 60 from anilox roller 28.

By adjusting the plate roller speed indicator 140, which is determined by the speed of second motor 122, preview printer 10 can be made to duplicate the exact speed at which a flexographic printer to be simulated operates. The substrate and pressure between drive roller 62 and plate roller 60 can also be exactly duplicated such that the image produced with preview printer 10 will be identical or substantially identical to the image that will result when the substrate is printed in a full-size flexographic printer. This allows an ink supplier to test the ink supplied to a customer or it allows a printer to test different anilox rollers, inks, etc. needed to obtain a desired result. Only small amounts of ink are needed for testing and quick releases 42 allow anilox roller 28 and inking roller 26 to be easily removed for cleaning.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A flexographic preview printer comprising an inking unit and a printing unit, said inking unit having an inking roller in contact with an anilox roller for transferring ink from the inking roller to the anilox roller and a doctor blade for precision metering of the ink on the surface of the anilox roller;

said printing unit having a plate roller with an image to be printed and a drive roller for moving a substrate through a nip between the drive roller and the plate roller, said nip adjustable to the thickness of the substrate, said inking unit powered by a first gear train connected to a first motor through a throw-out clutch, said first motor initially activated and adapted to rotate the inking roller and the anilox roller at a set slow speed, said printing unit powered by a second gear train meshed with first gear train through a throw-in clutch and driven by a second motor, said second motor initially inactivated and adapted to rotate the plate roller and the drive roller at an adjustable speed that is higher than the speed at which the first motor rotates the inking roller and the anilox roller, said second motor activated when said plate roller is selectively brought into contact with the anilox roller, said anilox roller being in a rotational ratio of one to one with the plate roller, and said second motor driving the second gear train and said second gear train driving the first gear train through the throw-in clutch when the second motor is activated, said first gear train being disengaged from the first motor through the throw-out clutch when the first gear train is driven by the second gear train, whereby the inking unit is rotated at a set slow speed by the first motor and then disengaged from the first motor when the second motor is activated rotating the printing and inking units at an adjustable faster speed.

2. The preview printer of claim 1 having a frame with a base upon which is mounted a pair of spaced apart sidewalls, said anilox roller and inking roller journaled in the sidewalls, said inking roller mounted on a pair of horizontal slides in slideways in the sidewalls whereby the inking roller can be brought in and out of contact with the anilox roller.

3. The preview printer of claim 2 having a platform for supporting an ink tray with means for raising and lowering the platform, whereby the ink tray can be brought in and out of contact with the inking roller.

4. The preview printer of claim 2 having a platform for supporting an ink tray, at least one cam attached to a handle journaled in one of the sidewalls for raising and lowering the platform, whereby the ink tray can be brought in and out of contact with the inking roller.

5. The preview printer of claim 2 wherein the drive roller is journaled in the sidewalls on a pair of horizontal slides in slideways in the sidewalls whereby the plate roller can be brought in and out of contact with the anilox roller.

6. The preview printer of claim 5 with means for bringing the plate roller in and out of contact with the anilox roller.

7. The preview printer of claim 6 wherein the means for bringing the plate roller in and out of contact with the anilox roller is a pair of opposing plates in vertical slideways on the sidewalls, each of said plates having an elongated slot in which is received a pin attached to the horizontal slide, each of said plates connected to a piston rod of a pneumatic ram for reciprocating the plate in the slideway thereby bringing the plate roller in and out of contact with the anilox roller.

8. The preview printer of claim 1 wherein the anilox roller has a plurality of anilox bands.

9. The preview printer of claim 2 wherein the drive roller is journaled in the sidewalls on a pair of vertical slides in slideways in the sidewalls with means for adjusting the nip between the drive roller and the plate roller.

10. A flexographic preview printer comprising an inking unit and a printing unit, said inking unit having an inking roller in contact with an anilox roller for transferring ink from the inking roller to the anilox roller and a doctor blade for precision metering of the ink on the surface of the anilox roller;

said printing unit having a plate roller with an image to be printed and a drive roller for moving a substrate through a nip between the drive roller and the plate roller, said nip adjustable to the thickness of the substrate, said inking unit powered by a first gear train connected to a first motor through a throw-out clutch, said first motor initially activated and adapted to rotate the inking roller and the anilox roller at a set slow speed, said printing unit powered by a second gear train meshed with said first gear train through a throw-in clutch and driven by a second motor, said second motor initially inactivated and adapted to rotate the plate roller and the drive roller at an adjustable speed that is higher than the speed at which the first motor rotates the inking roller and the anilox roller, said second motor activated when said plate roller is selectively brought into contact with the anilox roller, said anilox roller being in a rotational ratio of one to one with the plate roller, said second motor driving the second gear train and said second gear train driving the first gear train through the throw-in clutch when the second motor is activated, said first gear train being disengaged from the first motor through the throw-out clutch when the first gear train is driven by the second gear train, and a programmable logic controller with a plate roller speed indicator, said controller controlling the speed of the second motor which sets the plate roller speed whereby the inking unit is rotated at a set slow speed by the first motor and then disengaged from the first motor when the second motor is activated rotating the printing and inking units at an adjustable faster speed.

11. The preview printer of claim 10 having a mode selector control allowing an operator to select between a manual and an automatic mode.

12. The preview printer of claim 11 having a jog switch for starting the second motor when the mode selector control is in the manual mode.

13. The preview printer of claim 11 wherein the controller has a first timing function and an electric eye for sensing the substrate as it is directed around the drive roller, said timing function providing a time delay sufficient for an operator to push the substrate around the drive roller into the nip between the drive roller and the plate roller before the controller starts the second motor and the plate roller is brought into contact with the anilox roller.

14. The preview printer of claim 13 wherein the controller has a second timing function providing a time delay sufficient for the substrate to discharge the substrate when the electric eye stops sensing substrate.

* * * * *